US008006861B2

(12) United States Patent
Kim

(10) Patent No.: US 8,006,861 B2
(45) Date of Patent: Aug. 30, 2011

(54) HOLDER FOR DISPOSABLE PAPER CONTAINER

(76) Inventor: Yeong Leul Kim, Seoul (KR)

( * ) Notice: Subject to any disclaimer, the term of this patent is extended or adjusted under 35 U.S.C. 154(b) by 587 days.

(21) Appl. No.: 12/215,530

(22) Filed: Jun. 27, 2008

(65) Prior Publication Data

US 2009/0321460 A1 Dec. 31, 2009

(30) Foreign Application Priority Data

Jun. 27, 2007 (KR) ..... 10-2007-0063848

(51) Int. Cl.
*B65D 25/00* (2006.01)

(52) U.S. Cl. ..... 220/737; 220/738; 220/739; 220/903; 229/403

(58) Field of Classification Search ..... 220/737, 220/738, 739, 903; 229/403
See application file for complete search history.

(56) References Cited

U.S. PATENT DOCUMENTS 5,205,473 A 4/1993 Coffin, Sr.
5,209,367 A 5/1993 Van Musscher et al.
5,226,585 A 7/1993 Varano
5,229,182 A 7/1993 Eisman et al.
5,385,260 A 1/1995 Gatcomb
5,425,497 A 6/1995 Sorensen
5,454,484 A 10/1995 Chelossi
5,697,550 A 12/1997 Varano et al.
5,794,843 A 8/1998 Sanchez
5,826,786 A 10/1998 Dickert
5,964,400 A 10/1999 Varano et al.
6,085,970 A 7/2000 Sadlier
6,196,454 B1 3/2001 Sadlier
6,257,485 B1 7/2001 Sadlier et al.
6,308,883 B1 10/2001 Schmelzer et al.
6,378,766 B2 4/2002 Sadlier
6,422,456 B1 7/2002 Sadlier
7,195,805 B2 3/2007 Breining et al.
2008/0087715 A1 * 4/2008 Robertson et al. ..... 229/403

* cited by examiner

*Primary Examiner* — Anthony Stashick
*Assistant Examiner* — Elizabeth Volz
(74) *Attorney, Agent, or Firm* — IM IP Law PLLC; C. Andrew IM

(57) ABSTRACT

A disposable paper container holder in the form of a circular-truncated-cone-shaped casing having open top and bottom ends. The disposable paper container holder comprises a body having an inner surface and an outer surface, and a plurality of dimples distributed throughout the body of the casing. The dimples comprises a plurality of debossed dimples protruding inwardly from the body and a plurality of embossed dimples protruding outwardly from the body to maximize a distance between the inner and outer surface of the body, thereby providing an improved heat-shielding effect. The disposable paper container holder can be integrated with a disposable paper container to provide an integrated disposable paper container.

16 Claims, 5 Drawing Sheets

4A

4B

5A

5B

5C

5D

HOLDER FOR DISPOSABLE PAPER CONTAINER

CROSS-REFERENCE TO RELATED APPLICATIONS

This application claims priority from Korean Application No. 10-2007-0063848 filed Jun. 27, 2007, which is incorporated by reference in its entirety.

TECHNICAL FIELD

The present invention relates to holders for disposable paper containers, and particularly to a holder of a disposable paper container which protects the user's hand when it is filled with hot drink or food, such as hot coffee, hot soup and the like.

DESCRIPTION OF THE RELATED ART

Conventional disposable paper cup holders have been formed into circular-truncated-cone-shaped casings having open top and bottom ends. Representative examples of the conventional casings include a corrugated casing which consists of a body and a corrugated sheet attached to an inner periphery of the body, and a dimpled casing in which dimples are distributed throughout a body. However, the corrugated casing has drawbacks of complicated configuration and excessively high fabrication costs, and the dimpled casing does not achieve sufficient heat-shielding effects using the dimples alone. In particular, since conventional cup holders have been fabricated as disposable products, the conventional cup holders are preferably made of pulp obtained by beating old or waste paper. The resulting pulp-made paper cup holder is problematic because it is easily torn or bursts when adopting a relatively high height of dimples due to low surface tension thereof. Further, the larger the dimples, the easier the dimples are collapsed by grasping power of the user's hand when the user grips the cup holder. In conclusion, the dimpled paper cup holder has substantially less practical effect and utility.

SUMMARY OF THE INVENTION

Therefore, the present invention has been made in view of the above problems, and it is an object of the present invention to provide a holder for disposable paper cups wherein a holder body, which is made of pulp obtained by beating old or waste paper, is improved in configuration so as to achieve enhanced heat-shielding effects.

When a disposable paper cup holder is made of old or waste paper, or the like, it is difficult to increase a height or size of dimples formed at a body of the cup holder, and this in turn makes sufficient heat-shielding effects difficult to achieve. As an effect to solve this problem, the inventor of the present invention has developed a disposable paper cup holder of the present invention wherein dimples are formed at a holder body to protrude inward and outward of the body. With this configuration, even if any one of the inwardly-protruding dimples and the outwardly-protruding dimples has a small height, a sufficient distance between a cup, received in the holder, and the user's hand can be accomplished from a total height of both the corresponding inwardly-protruding and outwardly-protruding dimples. Allowing the small-height dimples in turn has the effect of allowing the cup holder to be made of old or waste paper. In addition, the inventor of the present invention proposes that at least one inwardly-protruding debossed dimple, having a smaller size than that of the outwardly-protruding embossed dimple, be positioned at the center of each outwardly-protruding embossed dimple, thereby serving as a post of the outwardly-protruding embossed dimple. As a result, the cup holder of the present invention has no risk of the embossed dimples collapsing by grasping power of the user's hand when the user grips the cup holder.

In accordance with an exemplary embodiment of the present invention, a disposable paper container holder in the form of a circular-truncated-cone-shaped casing having open top and bottom ends comprises a body having an inner surface and an outer surface, and a plurality of dimples distributed throughout the body of the casing. The dimples comprises a plurality of debossed dimples protruding inwardly from the body and a plurality of embossed dimples protruding outwardly from the body to maximize a distance between the inner and outer surface of the body, thereby providing an improved heat-shielding effect.

In accordance with an exemplary embodiment of the present invention, a disposable paper container having a conical section with the wider end located towards the top of said disposable paper container comprises a holder. The holder is in the form of a circular-truncated-cone-shaped casing having open top and bottom ends, and affixed to the disposable paper container. The casing comprises a body having an inner surface and an outer surface, and a plurality of dimples distributed throughout the body of the casing. The dimples comprises a plurality of debossed dimples protruding inwardly from the body and a plurality of embossed dimples protruding outwardly from the body to maximize a distance between the inner and outer surface of the body, thereby providing an improved heat-shielding effect.

In accordance with an exemplary embodiment of the present invention, each debossed dimple is positioned in an area of a corresponding emobssed dimple, thereby reinforcing the embossed dimple. The embossed dimples are larger in size than the debossed dimples such that at least one debossed dimple is formed at each emobssed dimple. Alternatively, each debossed dimple is formed at the center of each emobssed dimple.

In accordance with an exemplary embodiment of the present invention, the embossed dimples occupy a large area of the body than the debossed dimples. The size and number of the emobssed dimples are larger than the size and the number of the debossed dimples.

In accordance with an aspect of the present invention, the height of each emobssed or debossed dimple is 4 mm or less, thereby providing 3-8 mm of distance between the inner and outer surface of the body.

The disposable paper container holder of the present invention substantially confirming with a conical section of a beverage cup, a soup cup, a soup bowl and the like. The disposable paper container holder being fabricated from new pulp or recycled paper.

The integrated disposable paper container of the present invention being a beverage cup, a soup cup, a soup bowl and the like. The integrated disposable paper container being fabricated from new pulp or recycled paper. Various other objects, advantages and features of the present invention will become readily apparent from the ensuing detailed description, and the novel features will be particularly pointed out in the appended claims.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

Figure 1:
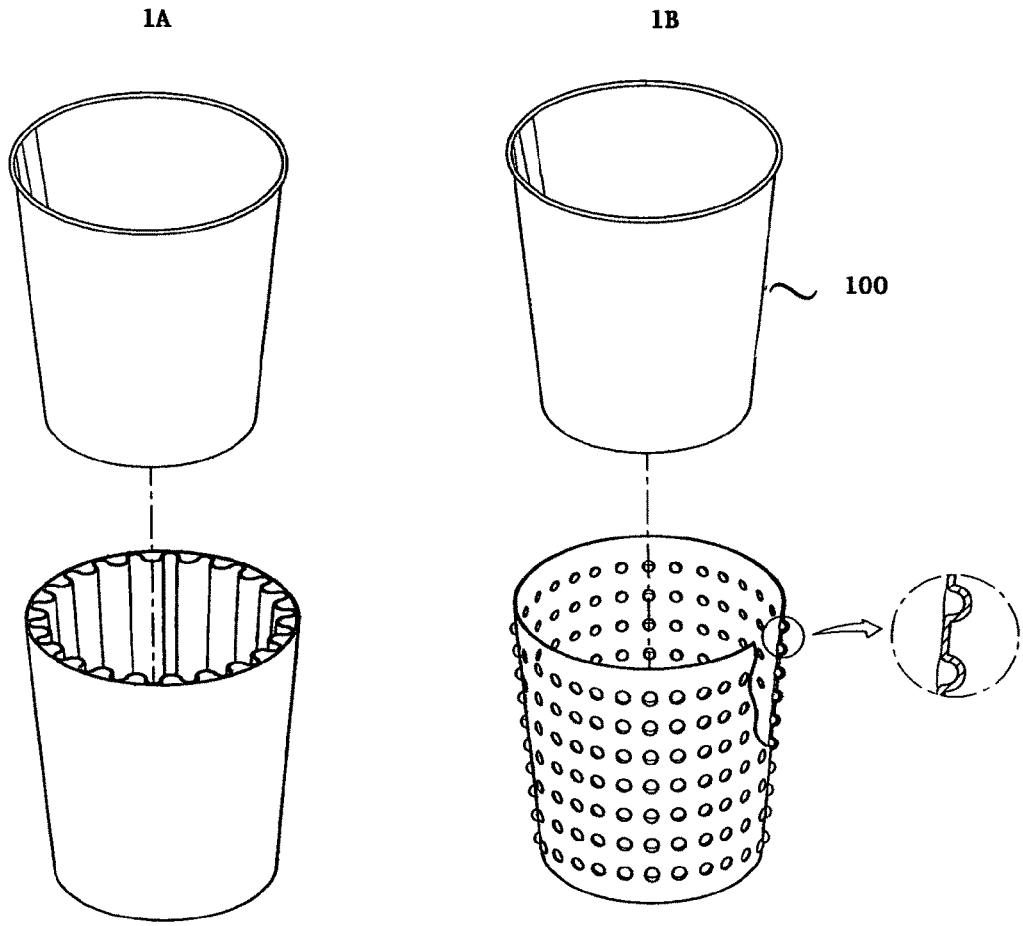
FIG. 1 (PRIOR ART)
FIGS. 1A and 1B are perspective views illustrating different conventional cup holders.
Figure 2:
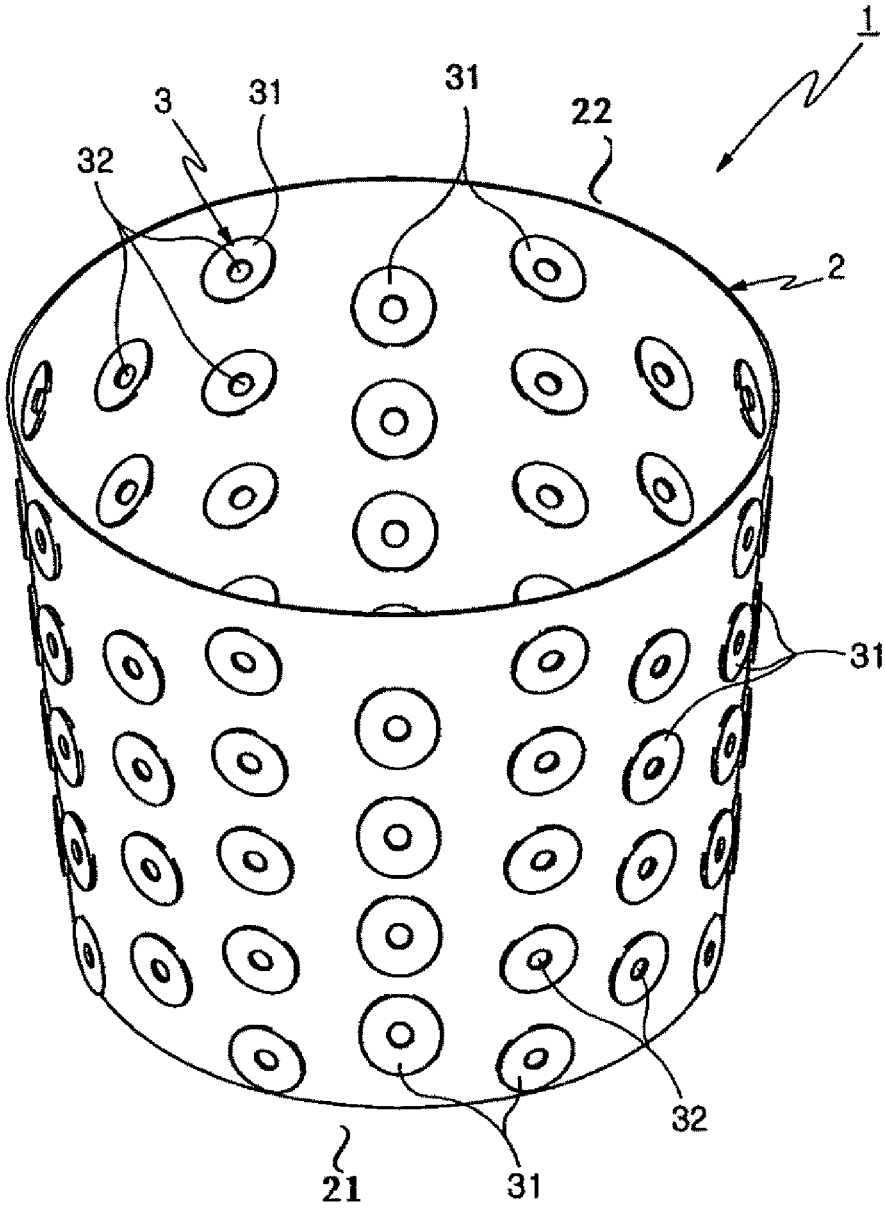
FIG. 2 is a perspective view illustrating a disposable paper container holder in accordance with an exemplary embodiment of the present invention.
Figure 3:
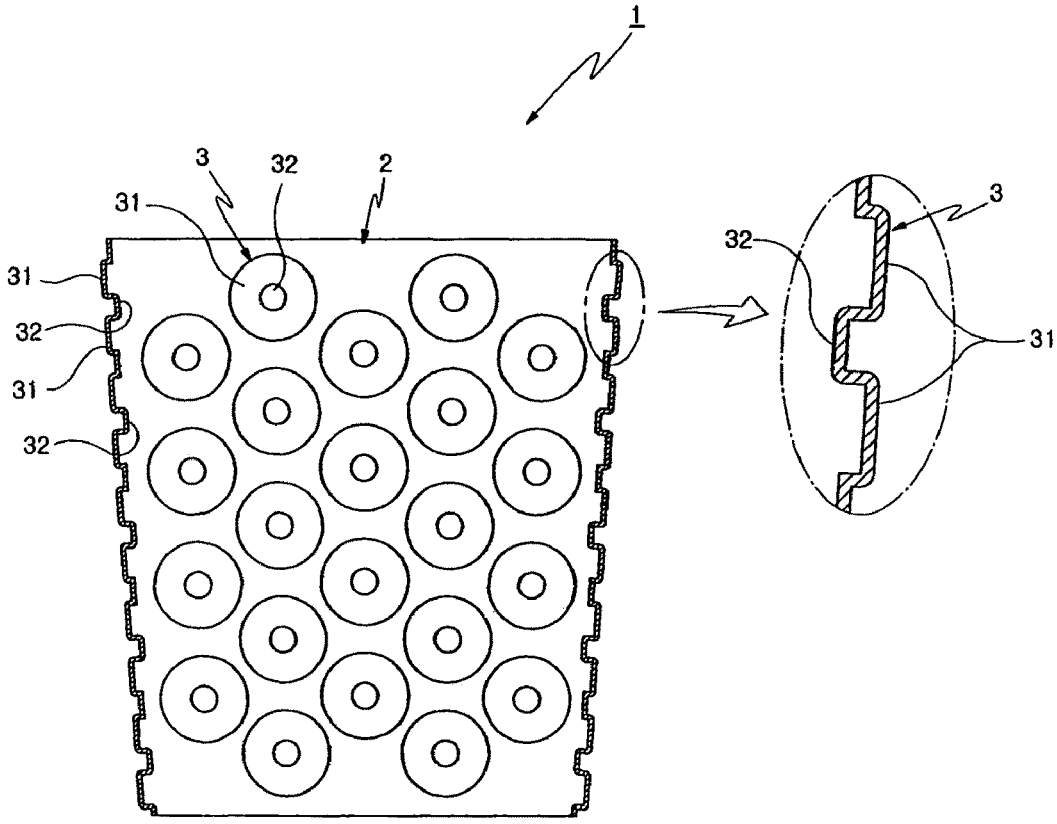
FIG. 3 is a sectional view of the disposable paper container holder shown in FIG. 2.
Figure 4:
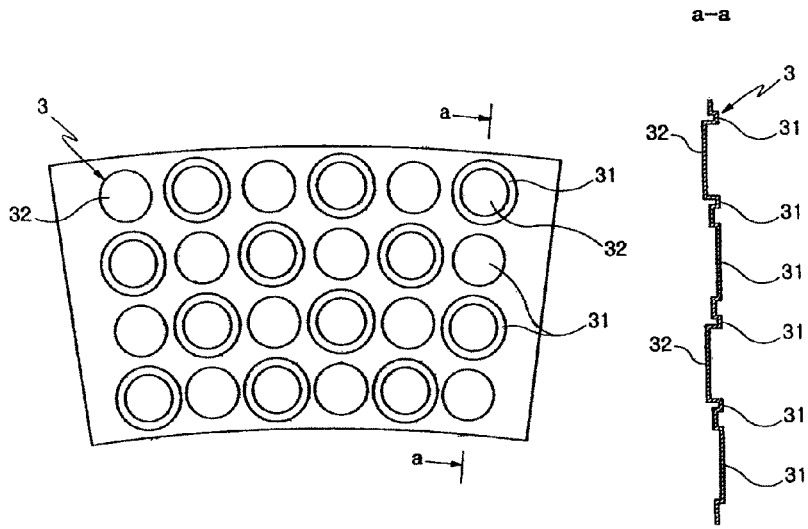
FIGS. 4A and 4B are development views and sectional views of disposable paper container holders in accordance with exemplary embodiments of the present invention.
Figure 4:
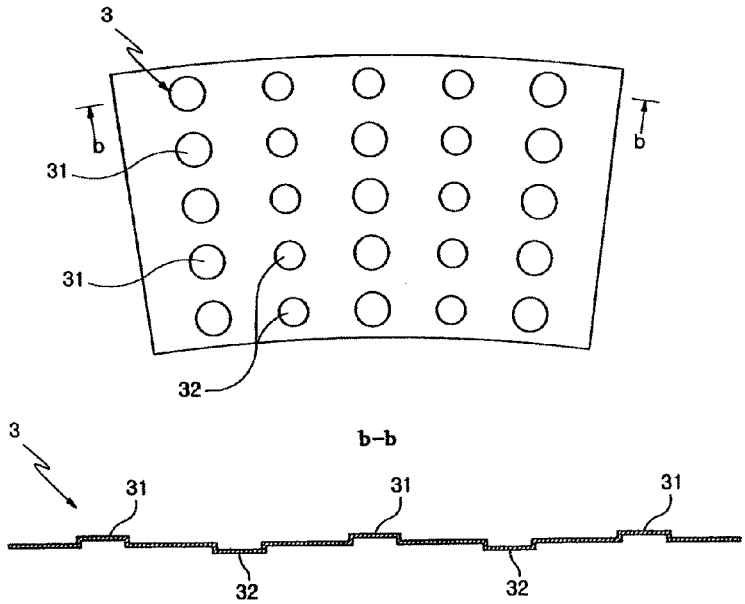

In accordance with an exemplary embodiment of the present invention, as shown in FIG. 2, a disposable paper container sleeve or holder 1 takes the form of a circular-truncated-cone-shaped casing having open top and bottom ends and the casing comprises a body 2 having an inner surface 22 and an outer surface 21, and a plurality of dimples 3 which are distributed throughout the body 2 and are configured to protrude inward and outward of the body 2. In accordance with an aspect of the present invention, the holder 1 can be separate from the container 100, as shown in FIGS. 2-4 or can be integrated with a disposable paper container 10 (referred to herein as the integrated disposable paper container 10), as shown in FIG. 5D. It is appreciated that the container 100 and/or integrated disposable paper container 10 includes but is not limited to a beverage cup, a soup cup or bowl and the like for holding hot drinks, hot soups and other hot foods.

Turning now to FIGS. 5A-D, there are illustrated an integrated disposable paper container 10 in accordance with exemplary embodiment of the present invention. FIG. 5A depicts a standard disposable paper container 100, such as a disposable paper cup, and a disposable paper container sleeve or holder 2 of the present invention. The disposable paper container sleeve or holder 2 is affixed to the sides of the disposable paper container 100 (as shown in FIGS. 5B-C) to form an integrated disposable paper container 10 with the disposable paper container sleeve or holder 2.

When forming dimples 3 in a paper made of new pulp rather than using recycled paper, the dimples 3 can be formed to have a depth in a range of 4~5 mm and thus, can provide the paper with excellent heat-shielding effects. However, when dimples are formed using paper made of recycled pulp obtained by processing old or waste paper, it can be difficult to obtain a required dimple height of 4 mm or more. To solve this problem, in accordance with an exemplary embodiment of the present invention, the dimples include debossed dimples 32 protruding inward from the body 2 (or protrude from the inner surface 22 of the body 2) and embossed dimples 31 protruding outward from the body 2 (or protrude from the outer surface 21 of the body 2). Preferably, the inwardly-protruding debossed dimples 32 and outwardly-protruding embossed dimples 31 have a height of 4 mm or less such that a total height of the corresponding inwardly-protruding and outwardly-protruding dimples is in a range of 3~8 mm. As a result, the disposable paper container holder 1 and the integrated disposable paper container 10 in accordance with an exemplary embodiment of the present invention can be fabricated even using recycled pulp obtained by processing old or waste paper and the like.

In accordance with an exemplary embodiment of the present invention, as shown in FIG. 4A, the inwardly-protruding debossed dimples 32 are configured to be smaller in size and number than the outwardly-protruding embossed dimples 31. This advantageously enables the embossed dimples 31 protruding outward from the body 2 to occupy a larger area than the debossed dimples 32 protruding inward from the body 2. This has added advantage in that the user's hand touches the outwardly-protruding dimples 31 without contacting the body 2, thereby protecting the user's hand from the hot beverage or food in the container 100 or the integrated disposable paper container 10 and providing improved heat-shielding effect.

In accordance with an exemplary embodiment of the present invention, the dimples 3 have a diameter in a range of 3~150 mm and a height in a range of 0.2~4 mm. In accordance with an aspect of the present invention, at least one debossed dimple 32 can be formed at each embossed dimple 31, when the outwardly-protruding embossed dimples 31 have a larger diameter and/or size than the debossed dimple 32, as shown in FIGS. 2-5. This has the effect of advantageously reinforcing the embossed dimple 31 and assuring a safe distance between user's hand and the body 2 of the holder 1 or integrated disposable paper container 10. As a result, the disposable paper container holder 1 of the present invention has no risk of being partially collapsed or distorted by grasping power of the user's hand.

The dimples 3 formed at the disposable paper container holder 1 of the present invention can be formed into any one of various shapes. FIG. 3 illustrates one exemplary shape of the dimples 3, but the present invention is not limited to the shown shape. For example, the dimples 3 can be formed into any other shapes including letters, flowers, animals or the like.

As apparent from the above description, the present invention provides a disposable paper container holder 1 (separate from the container 100 or integrated with the disposable paper container 10) having the following effects.

Firstly, the disposable paper container holder 1 of the present invention is configured in such a manner that dimples 3 are distributed throughout the body 2 of the holder 1 or integrated disposable paper container 10 (after the holder 1 is affixed to the disposable paper container) to protrude inward and outward of the body 2. The inwardly-protruding and outwardly-protruding dimples 3 advantageously enables the present invention to provide a sufficient distance between the container, the holder and the user's hand to provide improved heat-shielding effects.

Figure 5:
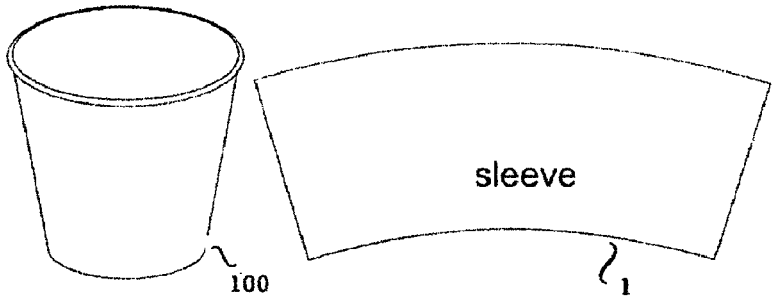
FIGS. 5A-D are perspective views illustrating an integrated disposable paper container in accordance with an exemplary embodiment of the present invention.
Figure 5:
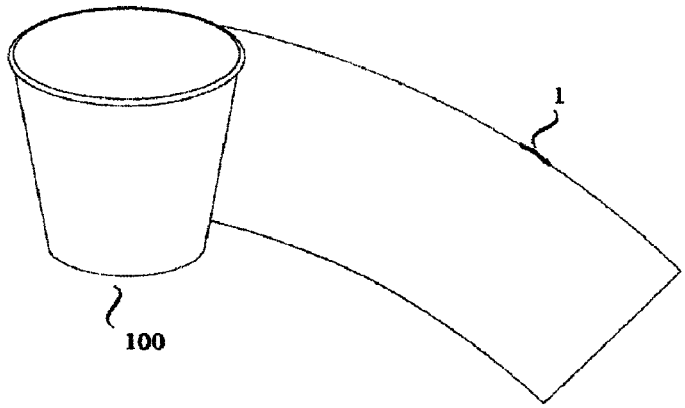
Figure 5:
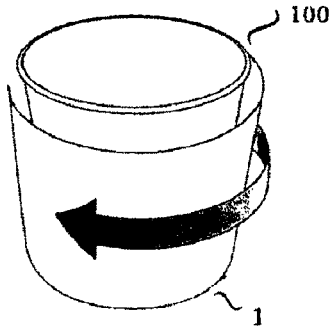
Figure 5:
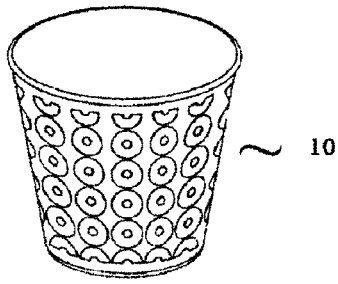

Secondly, in accordance with an exemplary embodiment of the present invention, the inwardly-protruding and outwardly-protruding dimples 31, 32 are formed at the body 2 such that each inwardly-protruding debossed dimple 32 is located at the center of the corresponding outwardly-protruding embossed dimple 31, as shown in FIGS. 2-3 and 5. As a result, each debossed dimple 32 can serve as a post of the embossed dimple 31, thereby advantageously reinforcing the embossed dimple 31 from at the body 2.

Furthermore, as a result of aligning the inwardly-protruding and outwardly-protruding dimples 31, 32 in a straight line in accordance with an exemplary embodiment of the present invention, the dimples 3 having a small height can be formed and in turn, the small-height dimples 3 can be easily fabricated even using recycled pulp. Accordingly, the disposable paper container holder 1 and the integrated disposable paper container 10 of the present invention can be advantageously fabricated using recycled paper, thereby greatly minimizing the manufacturing cost.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A disposable paper container holder in the form of a circular-truncated-cone-shaped casing having open top and bottom ends, comprising:

a body having an inner surface and an outer surface; and a plurality of dimples distributed throughout the body of said casing; and wherein said dimples comprises a plurality of debossed dimples protruding inwardly from the body and a plurality of embossed dimples protruding outwardly from the body, each debossed dimple being smaller than each embossed dimple and formed within a corresponding embossed dimple to reinforce said each embossed dimple and to effectively increase the height of said each embossed dimple, thereby providing an improved heat-shielding effect.

2. The disposable paper container holder of claim 1, wherein each debossed dimple is formed at the center of each embossed dimple.

3. The disposable paper container holder of claim 1, wherein said plurality of embossed dimples occupy a larger area of the body than said plurality of debossed dimples.

4. The disposable paper container holder of claim 1, wherein size and number of said plurality of embossed dimples are larger than the size and the number of said plurality of debossed dimples.

5. The disposable paper container holder of claim 1, wherein height of each embossed or debossed dimple is 4 mm or less, thereby providing said distance of 3-8 mm between the inner and outer surface of the body.

6. The disposable paper container holder of claim 1, wherein said disposable paper container holder substantially conforms with a conical section of a beverage cup.

7. The disposable paper container holder of claim 1, wherein said disposable paper container holder substantially conforms with a conical section of a soup cup or bowl.

8. The disposable paper container holder of claim 1, wherein said disposable paper container holder is fabricated from recycled paper.

9. A disposable paper container having a conical section with the wider end located towards the top of said disposable paper container, comprising:

a holder in the form of a circular-truncated-cone-shaped casing having open top and bottom ends, and affixed to said disposable paper container, comprising:

a body having an inner surface and an outer surface; and a plurality of dimples distributed throughout the body of said casing; and wherein said dimples comprises a plurality of debossed dimples protruding inwardly from the body and a plurality of embossed dimples protruding outwardly from the body, each debossed dimple being smaller than each embossed dimple and formed within a corresponding embossed dimple to reinforce said each embossed dimple and to effectively increase the height of said each embossed dimple, thereby providing an improved heat-shielding effect.

10. The disposable paper container of claim 9, wherein each debossed dimple is formed at the center of each embossed dimple.

11. The disposable paper container of claim 9, wherein said plurality of embossed dimples occupy a larger area of the body than said plurality of debossed dimples.

12. The disposable paper container of claim 9, wherein size and number of said plurality of embossed dimples are larger than the size and the number of said plurality of debossed dimples.

13. The disposable paper container of claim 9, wherein height of each embossed or debossed dimple is 4 mm or less, thereby providing said distance of 3-8 mm between the inner and outer surface of the body.

14. The disposable paper container holder of claim 9, wherein said disposable paper container is a beverage cup.

15. The disposable paper container of claim 9, wherein said disposable paper container is a soup cup or bowl.

16. The disposable paper container of claim 9, wherein said disposable paper container is fabricated from recycled paper.

* * * * *